US005605496A

United States Patent [19]

Pickard

[11] Patent Number: 5,605,496

[45] Date of Patent: Feb. 25, 1997

[54] ABRASIVE BLASTING GUN

[75] Inventor: Robert W. Pickard, McLoud, Okla.

[73] Assignee: The Pickard's Trust, McLoud, Okla.

[21] Appl. No.: 434,352

[22] Filed: May 2, 1995

[51] Int. Cl.[6] ..... B24C 3/00

[52] U.S. Cl. ..... 451/90; 239/526; 451/102

[58] Field of Search ..... 451/101, 102, 451/90; 239/576, 530, 526, 533.13

[56] References Cited

U.S. PATENT DOCUMENTS

| | | | |
|---|---|---|---|
| 1,631,167 | 6/1927 | Tereau | 239/526 |
| 2,535,310 | 12/1950 | Mattison | 251/5 |
| 2,684,559 | 7/1954 | Greiser | 51/29 |
| 2,810,991 | 10/1957 | Mead et al. | 51/8 |
| 2,957,630 | 10/1960 | Lamb | 239/85 |
| 3,473,738 | 10/1969 | De Mattos | 239/530 |
| 3,758,039 | 9/1973 | Wagner | 239/576 |
| 4,286,755 | 9/1981 | Shipman | 239/530 |
| 4,339,897 | 7/1982 | Thompson et al. | 51/436 |
| 4,941,298 | 7/1990 | Fernwood et al. | 51/438 |
| 4,945,688 | 8/1990 | Yie | 51/439 |
| 4,961,537 | 10/1990 | Stern | 239/526 |
| 5,205,540 | 4/1993 | Clapp | 239/526 |
| 5,348,228 | 9/1994 | Wang | 239/526 |

FOREIGN PATENT DOCUMENTS

| | | | |
|---|---|---|---|
| 37314 | 5/1969 | Finland | 239/576 |

*Primary Examiner*—James G. Smith
*Assistant Examiner*—Derris H. Banks
*Attorney, Agent, or Firm*—Molly D. McKay, P.C.

[57] ABSTRACT

A device for use with artistic sandblasting. The device is a hand-held gun which receives an air/abrasive mixture via a flexible tube which enters the gun through a rear end of the gun. The tube extends through the gun's rear end, between a pinch point and a curved end of an adjustable, spring biased pivotal lever provided internally in the barrel of the gun and attaches to a nozzle removably provided at the front end of the gun. When the trigger is not depressed, the curved end of the lever is biased toward the pinch point, thus squeezing the tube and cutting off flow of the air/abrasive mixture through the gun. The air/abrasive mixture flows through the gun via the tube and out the nozzle when a trigger which is attached to the curved end of the pivotal lever is depressed toward a handle provided on the rear end of the gun and thereby moves the curved end of the lever away from the pinch point, allowing the tube to resume its original unsqueezed configuration.

14 Claims, 2 Drawing Sheets

ABRASIVE BLASTING GUN

BACKGROUND OF THE INVENTION

1. Field of the Invention

The present invention relates to a gun designed to be used in abrasive blasting applications. More specifically, the present invention is an abrasive blasting gun provided with an adjustable spring biased trigger and provided with a removable nozzle end for ease in replacing the internal plastic tube as it becomes worn due to abrasion from the air/abrasive mixture which flows therethrough.

2. Description of the Related Art

Artistic abrasive blasting is accomplished by an artist who employs an abrasive blasting gun instead of a brush in order to etch artwork in glass or other similar mediums. The artist is able to control the location of the air/abrasive stream flowing out of the gun by simply pointing the gun and pulling the trigger in order to start or stop the flow.

One problem which many abrasive blasting guns have is corrosion of the guns by the air/abrasive mixture. Corrosion to the guns requires constant repair or replacement of abraded components of the guns, and generally the guns must be taken out of service in order to accomplish these repairs or replacements. Guns which do not have straight paths through the guns for the air/abrasive mixture to traverse are particularly susceptible to abrasion at corners or curves created in the air/abrasive flow path. Also, those parts within the gun which function to stop and start the flow of air/abrasive are also particularly susceptible to abrasion.

Another problem with abrasive blasting guns is that most are not easily adjustable in order to function within a wide range of pressures and flow rates of air/abrasive mixtures. It is desirable to be able to operate a gun at air pressures ranging from about three pounds per square inch (psi) to about 50 psi and at abrasive flow rates from about two ounces per minute for shadow etching to about 14 pounds per minute for deep etching.

The present invention addresses these problems by providing an abrasive blasting gun having a flexible tube extending in a straight path through the gun which contains the air/abrasive mixture therein. The gun housing of this invention does not come into contact with the air/abrasive mixture, and therefore, the gun housing does not experience abrasion. The present invention is provided with an adjustable spring biased lever which normally squeezes the flexible tube against an upper pinch point in order to prevent the air/abrasive mixture from flowing through the gun. The lever can be pivoted away from the flexible tube by depressing a trigger provided on the gun, thereby allowing flow of the air/abrasive mixture through the gun to be resumed. The tube is attached to a removable nozzle which can be pulled out of the front of the gun along with the attached tube. Once removed from the gun housing, a worn portion of the tube can be removed and the remaining tube reattached to the nozzle. Once the worn portion has been removed, the nozzle and reattached tube are then returned to the gun housing without ever having to take the gun out of service.

It is one of the objectives of this invention to provide a gun which is not abraded by an air/abrasive mixture flowing therethrough.

It is a further objective of this invention to provide an adjustable and lightweight gun for doing artistic abrasive blasting.

It is still a further objective of this invention to provide a gun which can be easily and quickly serviced without requiring the gun to be disconnected from the source of the air/abrasive mixture.

SUMMARY OF THE INVENTION

The present invention is a gun for use in abrasive blasting. The gun is provided with a gun housing having a gun barrel extending between front and rear ends of the gun and a handle extending downward at the rear end so that the handle is roughly perpendicular to a longitudinal axis of the gun barrel. A flexible tube enters the rear end of the gun housing via a rear opening provided therein, extends between an upper pinch point and an upper curved end of a lever, and is attached to a nozzle removably secured between ledges provided internally in the gun housing adjacent a front opening provided in the front end of the gun. The upper curved end of the lever is provided with a trigger extending downward therefrom and extending through a trigger opening provided in the gun housing adjacent the handle.

The lever is provided with an opposite lower end and the lever is pivotally secured at a point on the lever approximately midway between the lower end and the upper curved end to a fulcrum which is provided within the gun housing at a point slightly rearward and below the upper pinch point. The lower end of the lever is attached to a first end of a stretched bias spring provided within the handle. A second end of the spring is attached to an internal end of a bias spring screw. The bias spring screw movably extends through a bushing provided in a lower end of the handle. A traveling nut is movably provided external to the gun housing and between the bushing and a head end of the screw. The traveling nut is provided internally with nut threads which movably engage screw threads provided externally on the screw. Whenever the traveling nut is turned, the screw either moves toward or away from the spring depending on the direction the traveling nut is turned, thereby decreasing or increasing the tension on the spring and thus decreasing or increasing the force exerted downward on the lower end of the lever.

A receiving end of the flexible tube is secured to an external source of air/abrasive mixture and an opposite delivery end of the flexible tube is secured to a nipple provided on a first end of a hollow nozzle housing holder by means of a cable clamp. A second end of the nozzle housing holder is provided externally with hex-shaped holder shoulders which removably insert through the front opening and between the ledges to removably secure the nozzle within the gun housing. The second end of the nozzle housing holder is provided internally with female holder threads which removably receive first male housing threads provided externally on a first end of a hollow nozzle housing. A second end of the nozzle housing is provided externally with second male housing threads and the nozzle housing is provided externally with hex-shaped housing shoulders located between the first and second male housing threads. The second end of the nozzle housing is provided internally with a reduced diameter section which removably receives a first end of a hollow nozzle tip. The nozzle tip extends through a hollow housing nut. Female housing nut threads provided internally on a first end of the housing nut removably receive the second male housing threads. The housing nut is provided internally with a cavity adjacent to said female housing nut threads and into which an O-ring which encircles the nozzle tip inserts. The housing nut is provided externally with hexoshaped housing nut shoulders. The nozzle tip is provided with a second end through which the air/abrasive mixture exits the gun at the front end of the gun.

Collectively, the clamp, nozzle housing holder, the nozzle housing, the housing nut, the O-ring and the nozzle tip comprise the nozzle. The nozzle can be pulled out of the gun housing in order to replace the flexible tube as the tube becomes worn.

DETAILED DESCRIPTION OF THE PREFERRED EMBODIMENT

Figure 1:
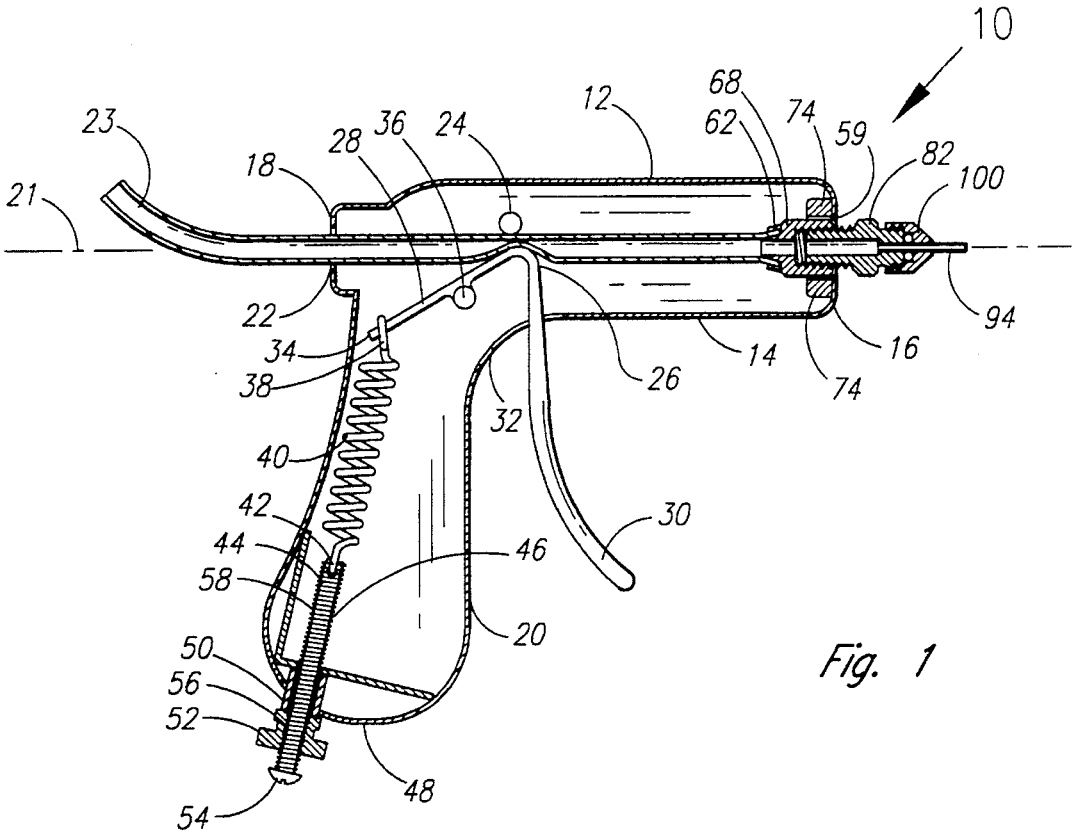
FIG. 1 is a cut-away right elevation of a gun constructed accordance with a preferred embodiment of the present invention.

Referring now to the drawings, and initially to FIG. 1, there is illustrated an abrasive blasting gun 10 constructed according to a preferred embodiment of the present invention. The gun 10 is provided with a gun housing 12 having a gun barrel 14 which extends between a front end 16 and an opposite rear end 18. Adjacent the rear end 18, the gun housing 12 is provided with a handle 20 which extends downward approximately perpendicular to a longitudinal axis 21 of the gun barrel 14. The gun housing 12 is provided with a rear opening 22 at its rear end 18 to admit a flexible tube 23. The tube 23 is attached on a receiving end (not shown) to a source (not shown) of air/abrasive mixture. The air/abrasive mixture flows through the tube 23. The tube 23 extends through the gun barrel 14, as will be more particularly described hereafter.

Figure 2:
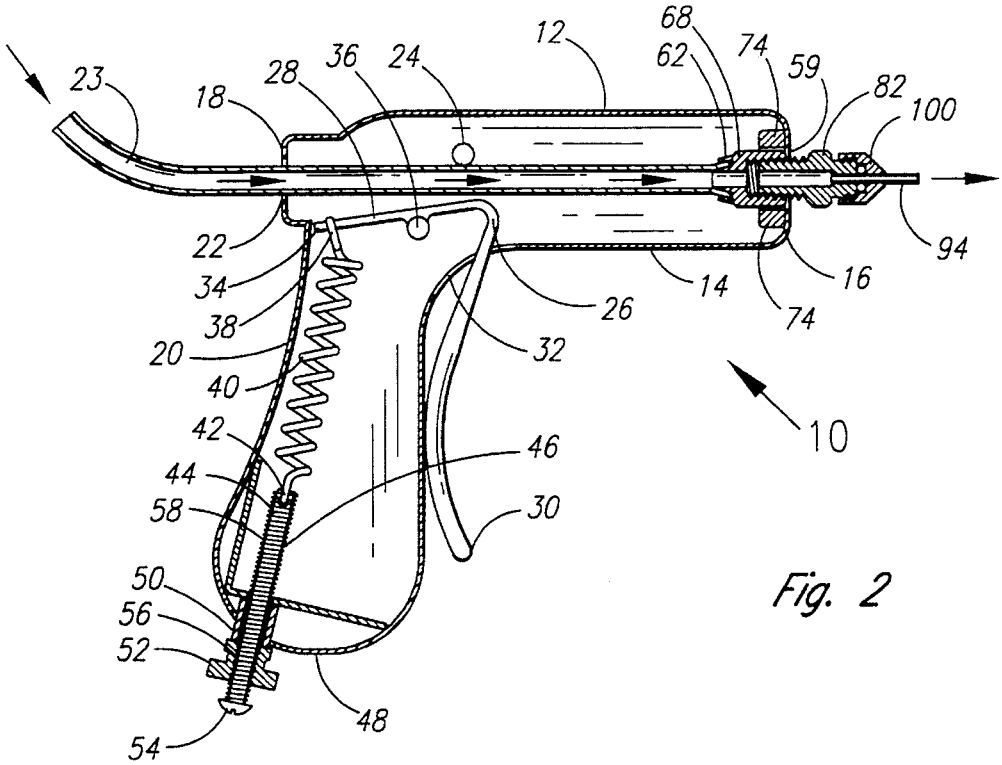
FIG. 2 is the gun of FIG. 1, showing the trigger depressed.

The tube 23 extends between an upper pinch point 24 provided in the gun barrel 14 and a forwardly extending upper curved end 26 of a lever 28. The upper curved end 26 of the lever 28 is provided with a downwardly extending trigger 30 which extends through the gun housing 12 via a trigger opening 32 provided in the gun housing 12. A fulcrum 36 is provided in the gun housing 12 slightly below and rearward of the upper pinch point 24. The lever 28 is provided rearwardly with an opposite lower end 34. The lever 28 pivotally attaches to the fulcrum 36 at a point on the lever 28 approximately midway between the upper curved end 26 and the lower end 34. The lower end 34 of the lever 28 is attached to a first end 38 of a stretched bias spring 40 provided within the handle 20. An opposite second end 42 of the stretched bias spring 40 is attached to an internal end 44 of a bias spring screw 46. The bias spring screw 46 extends out of a lower end 48 of the handle via a bushing 50 in which the screw 46 is freely rotatable. The screw 46 is also provided with a traveling nut 52 located between a head end 54 of the screw 46 and the bushing 50 and abutting the bushing 50. The traveling nut 52 is provided internally with nut threads 56 which rotatably engage screw threads 58 provided externally on the screw 46. Thus when the traveling nut 52 is rotated, the screw 46 moves either away from or toward the stretched bias spring 40, depending on the direction of rotation, thereby either putting more tension on the spring 40 or releasing some of the tension already on the spring 40. Additional tension is placed on the spring 40 in order to squeeze the tube 23 more firmly between the stationary upper pinch point 24 and the upper curved end 26 of the lever 28. This is done when the bias spring 40 pulls downward on the lower end 34 of the lever 28, causing the lever 28 to pivot at the fulcrum 36 and forcing the upper curved end 26 of the lever 28 into closer association with the upper pinch point 24, and thereby squeezing the tube 23 therebetween, as illustrated in FIG. 1. When the tube 23 is thus squeezed together, flow of air/abrasive mixture through the gun 10 is stopped. In order to restore flow of the air/abrasive mixture, the trigger 30 is depressed toward the handle 20, as illustrated in FIG. 2. When the trigger 30 is depressed, as illustrated in FIG. 2, the attached upper curved end 26 of the lever 28 is pulled downward, causing the lever 28 to pivot at the fulcrum 36 and forcing the lower end 34 of the lever 28 to move upward against a force exerted on it by the stretched bias spring 40. As the upper curved end 26 is pulled downward, pressure of the air/abrasive mixture within the tube 23 causes the flexible tube 23 to return to its pre-pinched configuration and flow of the air/abrasive mixture is restored, as illustrated by the arrows in FIG. 2.

It is important that the tube 23 be straight and parallel to the longitudinal axis 21 of the gun barrel 14 between the rear and front ends 18 and 16 of the gun 10. The reason the tube 23 must be straight is that the air/abrasive mixture which traverses the tube 23 is extremely corrosive and will abrade the tube 23 if the tube 23 has any curves in it, causing the tube 23 to be weakened and fail or require frequent replacement.

Figure 3:
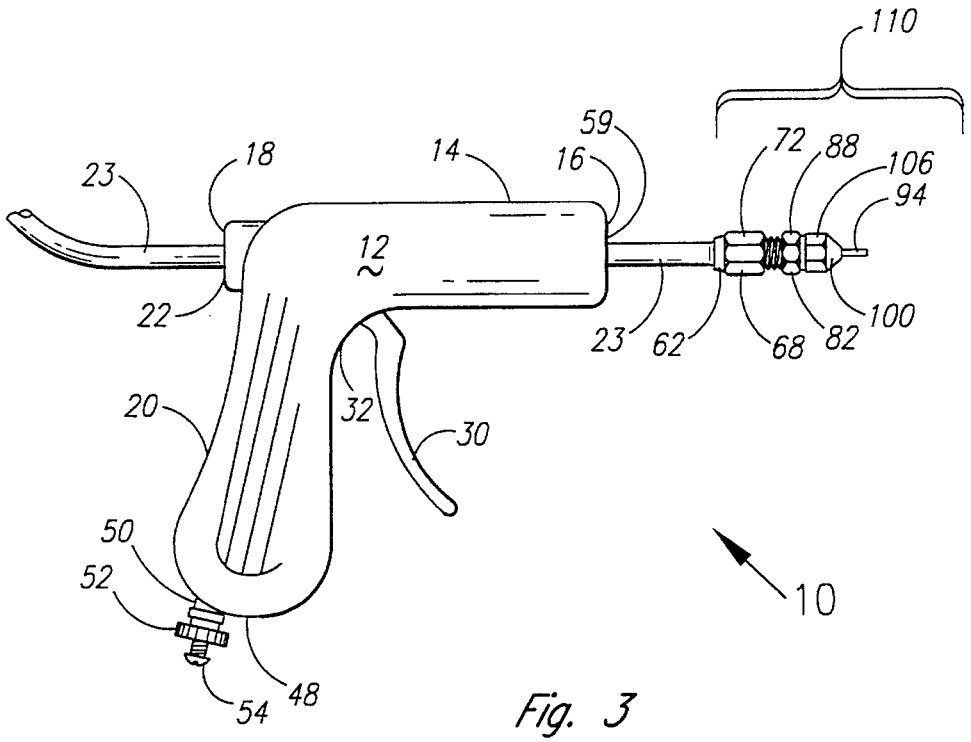
FIG. 3 is the gun of FIG. 2 showing the nozzle and associated fittings removed from the gun housing.

Referring now to FIGS. 1, 2 and 3, in order to feed the tube 23 through the gun barrel 14, the trigger 30 is first depressed, as shown in FIG. 2, and then the tube 23 is pushed through consecutively the rear opening 22 in the rear end 18, between the upper pinch point 24 and the upper curved end 26 of the lever 28 and out a front opening 59 provided in the front end 16.

Figure 4:
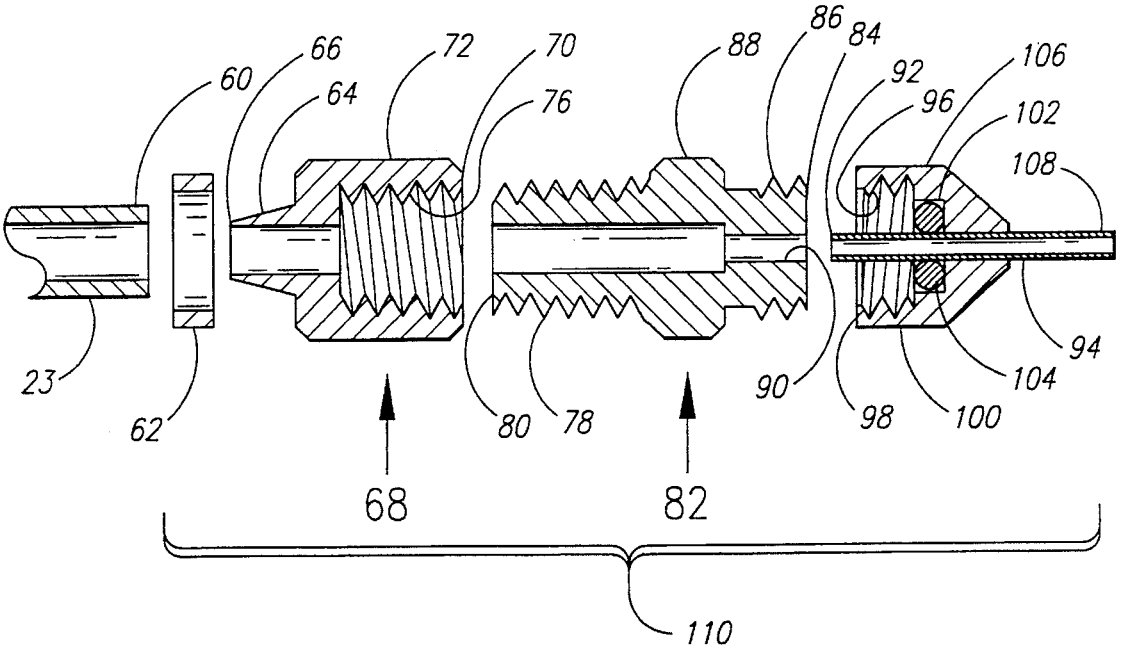
FIG. 4 is an exploded view of the nozzle from the gun of FIG. 3.

Referring now also to FIG. 4, a delivery end 60 of the tube 23 is then attached by means of a cable clamp 62 to a nipple 64 provided on a first end 66 of a hollow nozzle housing holder 68. An opposite second end 70 of the holder 68 is preferably provided externally with hex-shaped holder shoulders 72 which are slidably received between a pair of ledges 74 provided internally at the front end 16 of the gun barrel 14 and adjacent the front opening 59, as shown in FIGS. 1 and 2. The second end 70 of the nozzle housing holder 68 is provided internally with female holder threads 76 which removably receive first male housing threads 78 provided externally on a first end 80 of a hollow nozzle housing 82. An opposite second end 84 of the nozzle housing 82 is provided externally with second male housing threads 86. Hex-shaped housing shoulders 88 are provided externally on the nozzle housing 82 between the first and second male housing threads 78 and 86.

The second end 84 of the nozzle housing 82 is provided internally with a reduced diameter section 90 for slidably receiving a first end 92 of a hollow nozzle tip 94. The second male housing threads 86 are removably received by female housing nut threads 96 which are provided internally on a first end 98 of a housing nut 100. Internal to the female housing nut threads 96, the housing nut 100 is provided with a cavity 102 for receiving an O-ring 104. Externally the housing nut 100 is provided with hexshaped housing nut shoulders 106. The nozzle tip 94 is provided with a second end 108 through which the air/abrasive mixture exits the gun 10.

Collectively, the clamp 62, the nozzle housing holder 68, the nozzle housing 82, the housing nut 100, the O-ring 104, and the nozzle tip 94 comprise the nozzle 110. Once the tube 23 has been attached by means of the cable clamp 62 to the assembled nozzle 11 0, the trigger 30 is again depressed, allowing the nozzle 110 and attached tube 23 to be slid as a unit rearward, until the shoulders 72 of the nozzle housing holder 68 are received between the ledges 74. The trigger 30 is then released and the gun 10 is ready for use in sandblasting.

Over time, a segment of the tube 23 will become worn where the tube 23 is pinched between the upper pinch point 24 and the upper curved end 26 of the lever 28 and will require replacement. The tube 23 can be shortened, thereby eliminating the worn segment by first depressing the trigger 30 so the nozzle 110 and attached tube 23 can be pulled out of the front end 16 of the gun housing 12, then removing the delivery end 60 of the tube 23 from the nipple 64, cutting off and discarding a short segment of the tube 23, reattaching the new delivery end 60 of the tube 23 to the nipple 64 and securing it thereon with the clamp 62, and again depressing the trigger 30 so the nozzle 110 and attached tube 23 can be reinserted into the front end 16 of the gun housing 12. Removal of a segment of tube 23 can be done without taking the gun 10 out of service. However, when an entirely new tube 23 is needed, i.e., when the tube 23 becomes too short or excessively worn due to the air/abrasive mixture which flows therethrough, the gun 10 must be taken out of service, i.e., gun 10 must be disconnected from a source of the pressurized air/abrasive mixture in order to replace the entire tube 23.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. An abrasive blasting gun for use in sandblasting comprising:

barrel means for holding a flexible tube in a straight path between a rear end and a front end of said barrel means, a pinch point provided on the barrel means on one side of said flexible tube, a first end of a spring being attached to a lower end of a pivotal lever provided on an opposite side of said flexible tube so that said spring pulls said lower end away from said tube causing an upper end of said lever to be normally biased toward said pinch point and causing said flexible tube to be normally pinched between said pinch point and said upper end of said lever, a trigger provided on said lever for pivoting said upper end of said lever away from said pinch point when said trigger is depressed, a delivery end of said flexible tube removably secured to a nozzle provided at said front end of said barrel means.

2. A gun according to claim 1 further comprising:

a handle being provided at said rear end and extending approximately perpendicular to said barrel means.

3. A gun according to claim 1 wherein said pinch point is provided within a gun housing above said flexible tube.

4. A gun according to claim 3 wherein said lever is provided below said flexible tube.

5. A gun according to claim 4 further comprising:

a fulcrum provided within said gun housing slightly below and rearward of said pinch point, and said lever being pivotally attached to said fulcrum approximately midway between a lower end of said lever and said upper end of said lever.

6. A gun according to claim 1 wherein said nozzle is removably provided at said front end of said barrel means.

7. An abrasive blasting gun comprising:

barrel means for holding a flexible tube in a straight path between a rear end and a front end of said barrel means, a pinch point provided on the barrel means on one side of said flexible tube, a first end of a spring being attached to a lower end of a pivotal lever provided on an opposite side of said flexible tube so that said spring pulls said lower end away from said tube causing an upper end of said lever to be normally biased toward said pinch point and causing said flexible tube to be normally pinched between said pinch point and said upper end of said lever, a trigger provided on said lever for pivoting said upper end of said lever away from said pinch point when said trigger is depressed, a delivery end of said flexible tube removably secured to a nozzle provided at said front end of said barrel means, a handle being provided at said rear end and extending approximately perpendicular to said barrel means, means for adjusting tension on said spring being provided on said handle, and said means for adjusting tension attaching to a second end of said spring.

8. A gun according to claim 7 wherein said means for adjusting tension comprises:

said second end of said spring being attached to one end of a bias spring screw, said screw movably extending through a bushing provided in the handle, a traveling nut movably provided external to said handle and between said bushing and a head-end of said screw.

9. An abrasive blasting gun for use in sandblasting comprising:

barrel means for holding a flexible tube in a straight path between a rear end and a front end of said barrel means, a pinch point provided on the barrel means on one side of said flexible tube, a first end of a spring being attached to a lower end of a pivotal lever provided on an opposite side of said flexible tube so that said spring pulls said lower end away from said tube causing an upper end of said lever to be normally biased toward said pinch point and causing said flexible tube to be normally pinched between said pinch point and said upper end of said lever, a trigger provided on said lever for pivoting said upper end of said lever away from said pinch point when said trigger is depressed, a delivery end of said flexible tube removably secured to a nozzle provided at said front end of said barrel means, a handle being provided at said rear end and extending approximately perpendicular to said barrel means, a hollow nozzle housing holder being provided with a nipple on a first end, a clamp being provided around said delivery end of said flexible tube in order to secure said flexible tube to said nipple, a first end of a hollow nozzle housing removably securing to a second end of said nozzle housing holder, a second end of said nozzle housing being removably secured to a hollow nozzle tip by means of a removably housing nut.

10. A device for regulating flow of an air/abrasive mixture comprising:

a gun housing, a flexible tube being provided extending in a straight path through said gun housing, said flexible tube extending between a pinch point and a cooperating upper end of an upwardly biased lever provided within said gun housing in order that said flexible tube be normally pinched between said pinch point and said upper end, and trigger means being provided on said lever for downwardly biasing said upper end of said lever.

11. A device according to claim 10 wherein a receiving end of said flexible tube is attached to a source of an air/abrasive mixture and an opposite delivery end of said flexible tube is removably attached to a nozzle removably provided in a front end of said gun housing.

12. A device according to claim 10 wherein said lever is pivotally attached approximately midway between said upper end and a lower end of said lever to a fulcrum provided within said gun housing.

13. A device according to claim 12 wherein said fulcrum is located slightly below and rearward in the gun housing from said pinch point.

14. A device for regulating flow of an air/abrasive mixture comprising:

a gun housing, a flexible tube being provided extending in a straight path through said gun housing, said flexible tube extending between a pinch point and a cooperating upper end of an upwardly biased lever provided within said gun housing in order that said flexible tube be normally pinched between said pinch point and said upper end, trigger means being provided on said lever for downwardly biasing said upper end of said lever, a receiving end of said flexible tube being attached to a source of an air/abrasive mixture and an opposite delivery end of said flexible tube being removably attached to a nozzle removably provided in a front end of said gun housing, a clamp being provided around said delivery end of said flexible tube in order to removably secure said tube to one end of a hollow nozzle housing holder, shoulder means being provided externally on said nozzle housing holder for removably engagement with ledges provided internally in said front end of said gun housing, a second end of said nozzle housing holder being removably secured to a first end of a hollow nozzle housing, a second end of said nozzle housing removably receiving a hollow nozzle tip, a hollow housing nut removably securing said nozzle tip to said second end of said nozzle housing, and an O-ring encircling said nozzle tip to seal said nozzle tip to said housing nut.

* * * * *